US008246421B2

(12) United States Patent
Pei

(10) Patent No.: US 8,246,421 B2
(45) Date of Patent: Aug. 21, 2012

(54) ARC SURFACE GRINDING DEVICE

(75) Inventor: Shao-Kai Pei, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 439 days.

(21) Appl. No.: 12/648,086

(22) Filed: Dec. 28, 2009

(65) Prior Publication Data

US 2011/0065367 A1 Mar. 17, 2011

(30) Foreign Application Priority Data

Sep. 11, 2009 (CN) ..... 2009 1 0306904

(51) Int. Cl.
*B24B 7/00* (2006.01)

(52) U.S. Cl. ..... 451/124; 451/11; 451/127; 451/27; 451/51; 451/61; 451/388

(58) Field of Classification Search ..... 451/11, 451/27, 124, 120, 231, 67, 119, 51, 61, 142, 451/388

See application file for complete search history.

(56) References Cited

U.S. PATENT DOCUMENTS

| | | | | | |
|---|---|---|---|---|---|
| 2,811,995 | A * | 11/1957 | Bremmer | 99/626 |
| 3,855,916 | A * | 12/1974 | Lazzarini | 99/623 |
| 4,795,496 | A * | 1/1989 | Karaki et al. | 134/8 |
| 5,679,061 | A * | 10/1997 | Thielenhaus | 451/51 |
| 6,012,973 | A * | 1/2000 | Nagel | 451/51 |
| 6,287,183 | B1 * | 9/2001 | Zhang et al. | 451/407 |
| 6,615,613 | B1 * | 9/2003 | Iwabuchi et al. | 65/61 |
| 2011/0065367 | A1 * | 3/2011 | Pei | 451/233 |

* cited by examiner

*Primary Examiner* — George Nguyen
(74) *Attorney, Agent, or Firm* — Altis Law Group, Inc.

(57) ABSTRACT

A grinding device includes a fixed barrel, a moving barrel, a grinding plate, and an actuator. The fixed barrel defines a chamber and includes a number of inner surfaces substantially parallel to a central axis, each of which defines a holding groove therein for holding a workpiece. The moving barrel is received in the chamber and includes a side surface substantially parallel to the central axis and defines an installation groove. The grinding plate is fixedly installed in the installation groove. The actuator is configured for driving the moving barrel to spin and move back and forth along the central axis, and driving the moving barrel to move towards a workpiece so that a surface of the workpiece is grinded into a desired arc surface by the grinding plate, and driving the moving barrel to move towards another workpiece after the desired arc surface of the workpiece is obtained.

8 Claims, 5 Drawing Sheets

ARC SURFACE GRINDING DEVICE

BACKGROUND

1. Technical Field

The present disclosure relates to grinding devices, and particularly, to an arc surface grinding device for grinding a number of workpieces at the same time whereby a surface of each of the workpieces is grinded into a desired arc surface.

2. Description of Related Art

Current arc surface grinding devices generally include a bed with fixture for holding one or more workpieces and a grinding part for grinding the workpieces so that a surface of each of the workpieces is grinded into a desired arc surface. To increase efficiency, a large size bed is required to hold many workpieces at the same time. As such, the grinding part can be used to continuously grind the workpieces, or more grinding parts can be employed to grind the workpiece simultaneously. However, the large size bed reduces space usage efficiency.

Therefore, it is desirable to provide a grinding device, which can overcome the above-mentioned problems.

DETAILED DESCRIPTION

Figure 1:
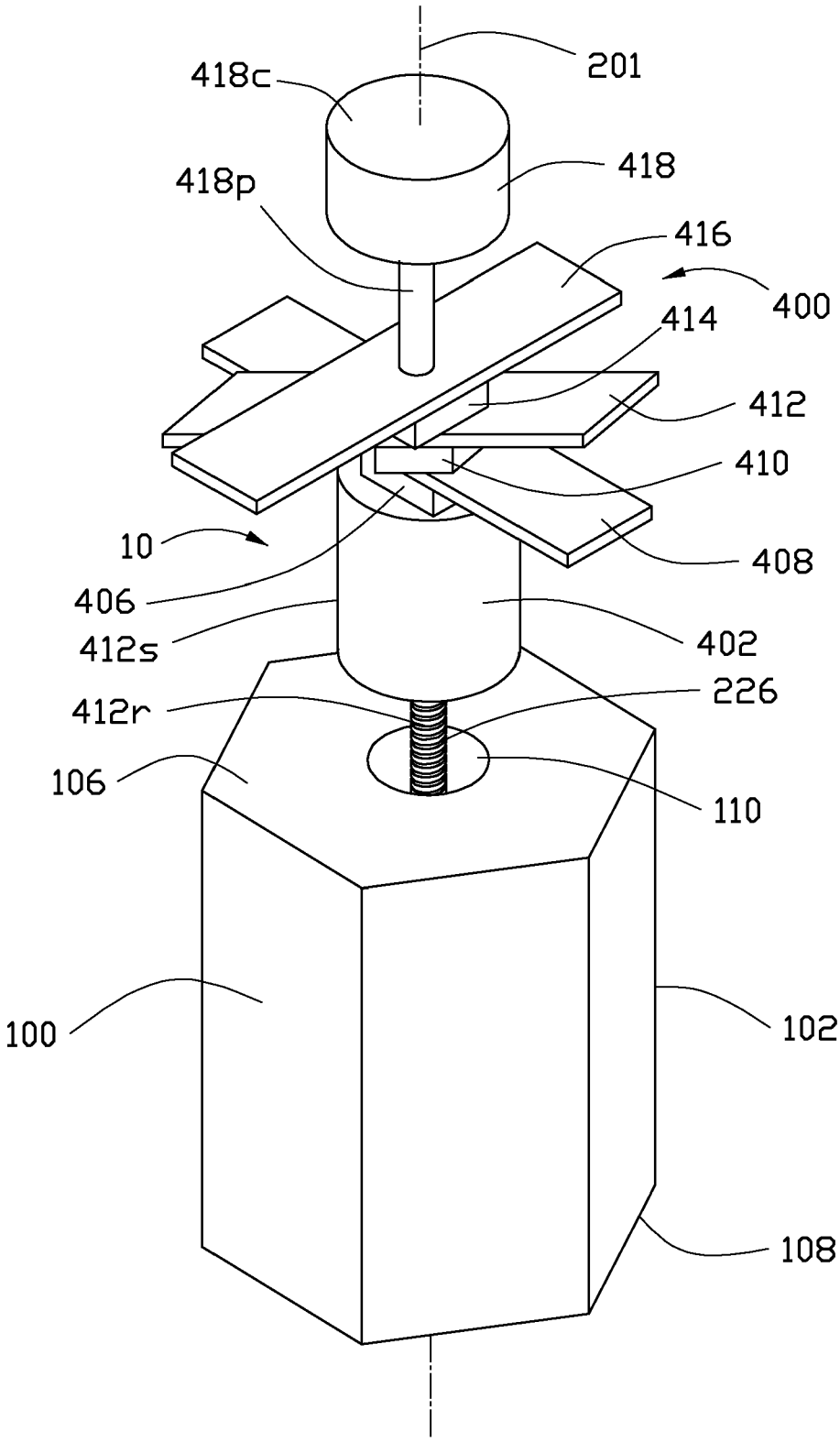
FIG. 1 is an isometric, schematic view of a grinding device, according to an exemplary embodiment.
Figure 2:
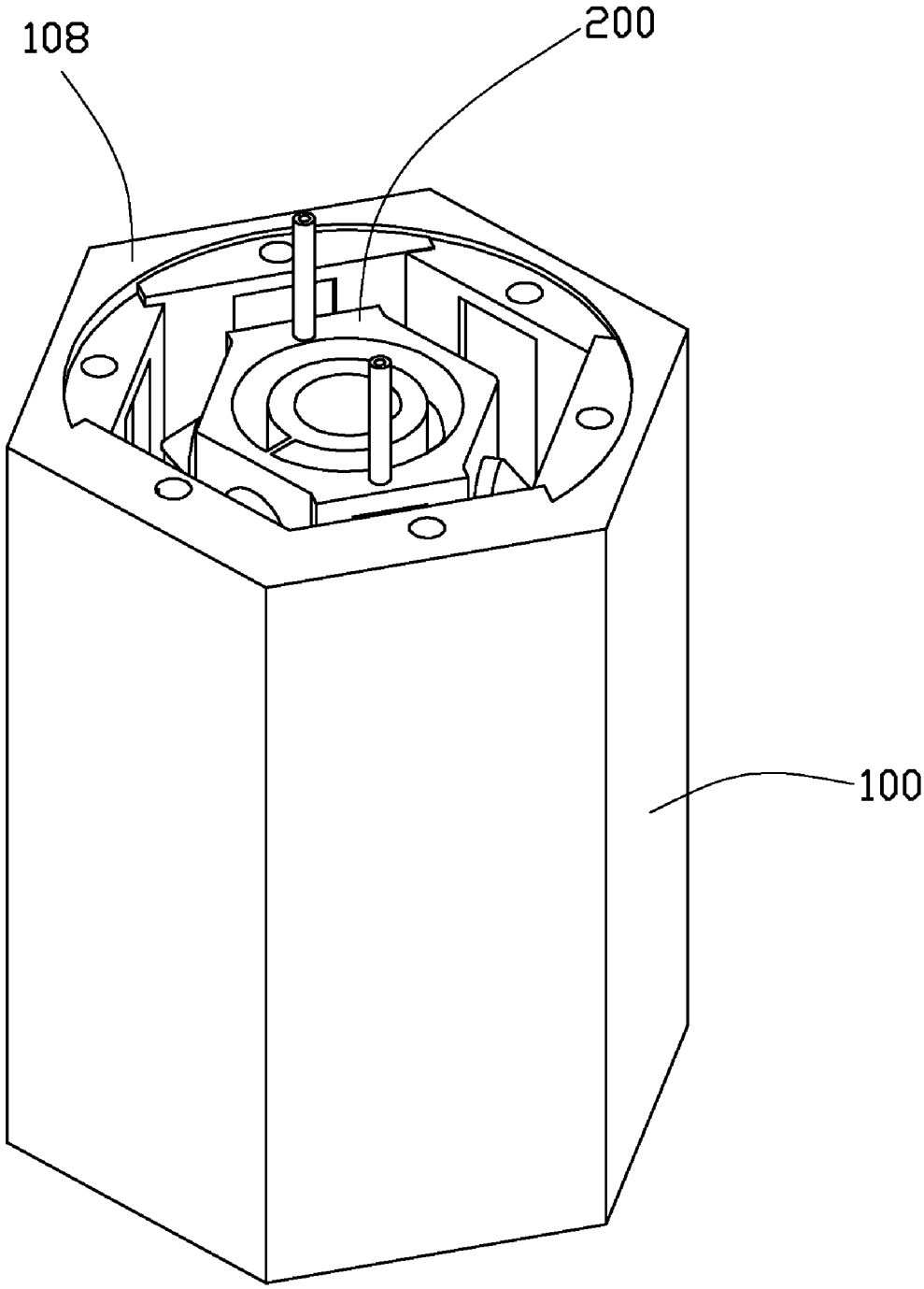
FIG. 2 is an isometric, schematic view of a fixed barrel and a moving barrel of the grinding device of FIG. 1.

Referring to FIGS. 1-2, a grinding device 10, according to an exemplary embodiment, is configured for grinding a number of workpieces (not shown) at the same time whereby a surface of each of the workpieces is grinded into a desired arc surface. The grinding device 10 includes a fixed barrel 100, a moving barrel 200, a number of grinding plates 300 (see FIG. 4), and an actuator 400.

Figure 3:
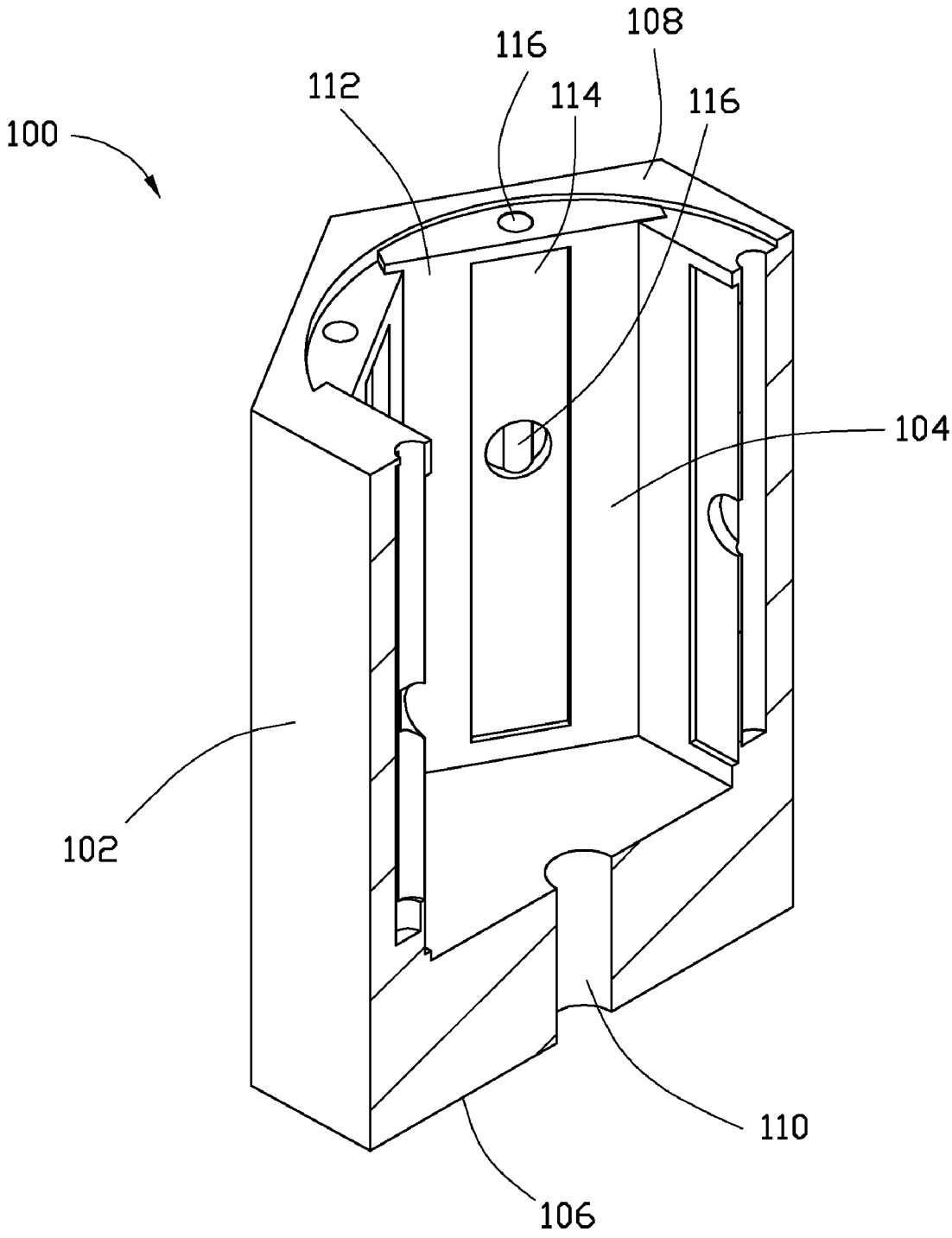
FIG. 3 is an isometric, cross-sectioned, schematic view of the fixed barrel of the grinding device of FIG. 1.

Referring to FIGS. 1 and 3, the fixed barrel 100 includes a first main body 102 which is generally a hexagonal prism in shape and is generally symmetrical about a central axis 201 of the fixed barrel 100. The first main body 102 includes a top plate 106 and a bottom plate 108.

The first main body 102 defines a hexagonal prism chamber 104 therein which is symmetrical about the central axis 201. The hexagonal prism chamber 104 passes through the bottom plate 108 and is bounded by six inner side surfaces 112 of the first main body 102. Each of the inner side surfaces 112 defines a holding groove 114 therein generally at the center thereof. Each of the holding grooves 114 is configured for holding a workpiece therein and is shaped corresponding to the workpiece. In this embodiment, the holding groove 114 is rectangular and arranged so that the length direction thereof is substantially parallel to the central axis 201. The first main body 102 also defines a number of first suction holes 116 therethrough. Each of the first suction holes 116 communicates a corresponding holding groove 114 with an external vacuum source (not shown) through the bottom plate 108. As such, after a workpiece is placed in a holding groove 114, the vacuum source is activated to suck the workpiece so that the workpiece is fixedly held by the holding groove 114. The top plate 106 defines a shaft hole 110 therethrough generally at the center thereof.

It should be understood that the hexagonal prism chamber 104 is not limited to this embodiment. To reduce or increase the number of the inner side surfaces 112 for holding less or more workpieces, other types of regular prism chamber having less or more inner side surfaces 112 can be employed.

The holding grooves 114 are not limited to this embodiment too. In other alternative embodiments, more holding grooves 114 can be defined in one inner side surface 112 and arranged in other suitable fashions. Also, less holding grooves 114 can be employed and selectively defined in certain portion of the inner side surfaces 112.

It also should be understood that the first suction holes 116 are for fixedly holding the workpieces in the holding grooves 114 and are not limited to this embodiment. In other alternative embodiments, the first suction holes 116 can be omitted, and other suitable fastening structures can be employed to fixedly hold the workpieces in the holding grooves 114.

Figure 4:
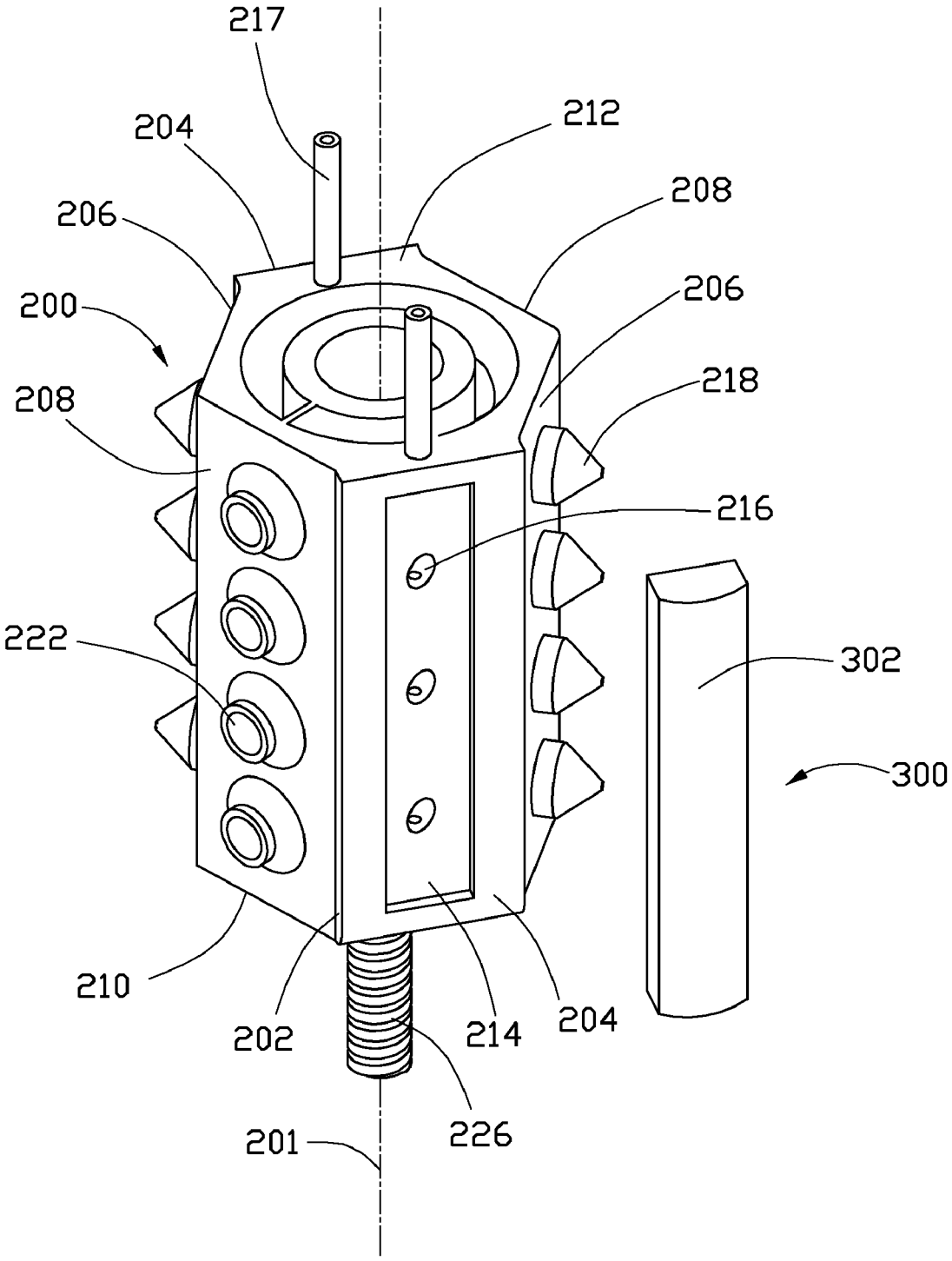
FIG. 4 is an isometric, schematic view of the moving barrel and a grinding plate of the grinding device of FIG. 1.

Referring to FIGS. 2 and 4, the moving barrel 200 is received within the hexagonal prism chamber 104. The moving barrel 200 includes a second main body 202 that is arranged along the central axis 201. In particular, the second main body 202 is generally a hexagonal prism and includes a top surface 210, a bottom surface 212, two opposite first side surfaces 204, two opposite second side surfaces 206, and two opposite third side surfaces 208.

Each of the first side surfaces 204 defines an installation groove 214 for installing a corresponding grinding plate 300 therein. The installation grooves 214 are shaped corresponding to the grinding plates 300 and are rectangular and arranged so that the lengthwise direction thereof is substantially parallel to the central axis 201. The moving barrel 200 further includes two suction tubes 217 perpendicularly extend downwards from the bottom surface 212 corresponding to the two first side surfaces 204. The suction tubes 217 communicate with the vacuum source. The second main body 202 defines two second suction holes 216 therethrough in the two installation grooves 214 respectively. The second suction holes 216 communicate with the suction tubes 217 respectively. As such, after the grinding plates 300 are placed into the installation grooves 214, the vacuum source is activated to suck to fixedly hold the grinding plates 300 in the installation grooves 214.

It should be understood that the installation grooves 214 are not limited to this embodiment. In other alternative embodiments, more installation grooves 214 can be defined in one first side surface 204 and arranged in other suitable fashions.

It should be understood that the suction tubes 217 and the second suction holes 216 can be omitted in other alternative embodiments and other suitable fastening structures can be employed instead to fixedly hold the grinding plates 300

The second main body 202 protrudes outwards of a number of water nozzles 218 from each of the second side surfaces 206. The water nozzles 218 are arranged in a line parallel to the central axis 201 generally at the center of the corresponding second side surface 206.

Figure 5:
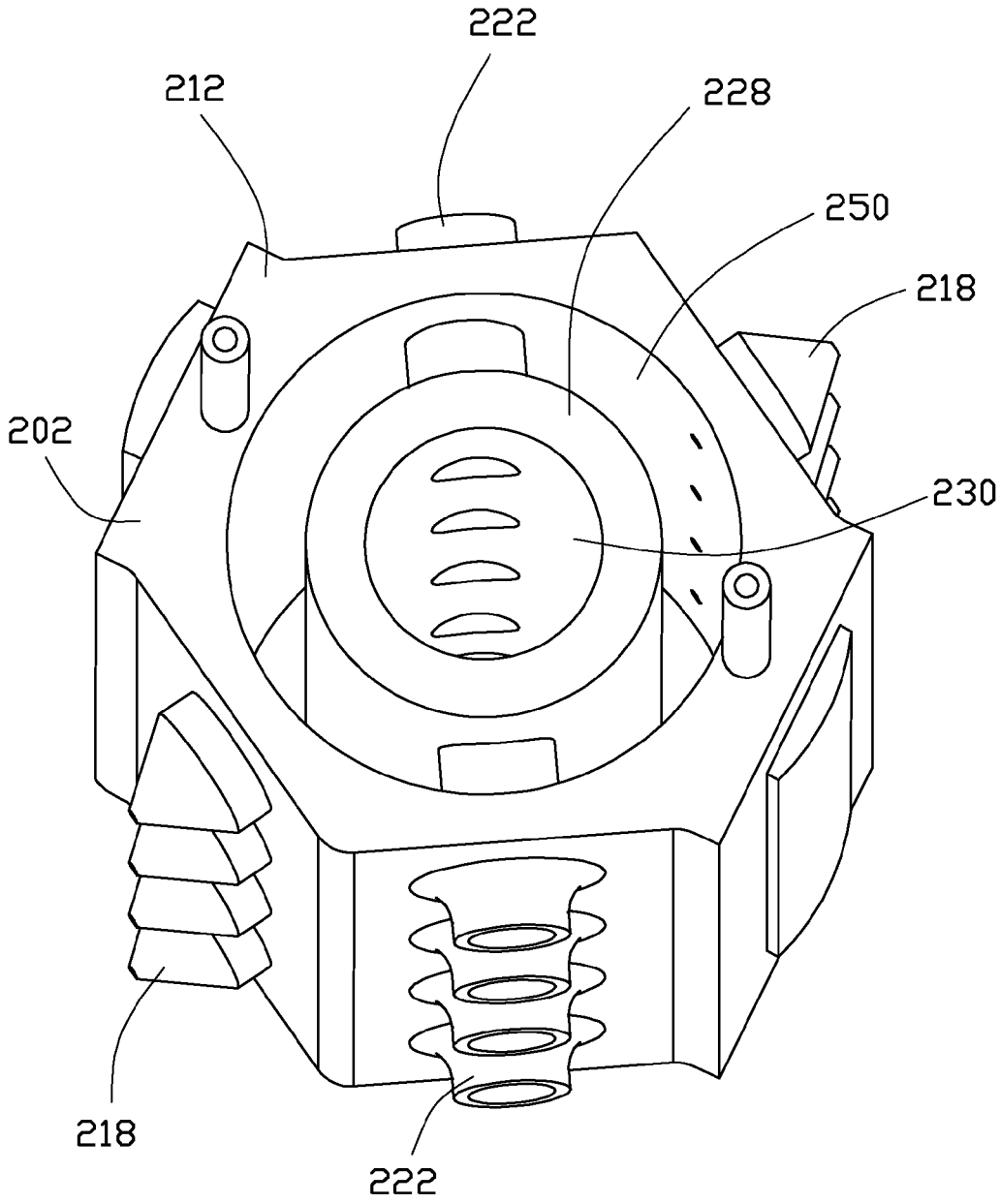
FIG. 5 is an isometric, schematic view of the moving barrel of the grinding device of FIG. 1, viewed at another angle.

Referring to FIGS. 4-5, the moving barrel 200 further includes an inner tube 228. The inner tube 228 is received in the second main body 202 and arranged along the central axis 201. The second main body 202 and the inner tube 228 cooperatively define a water chamber 250 therebetween. The water chamber 250 communicates with a water source (not shown). The inner tube 228 defines a grease chamber 230 therein. The grease chamber 230 communicates with a grease source (not shown). The water nozzles 218 communicate with the water chamber 250.

The second main body 202 further protrudes outwards a number of grease nozzles 222 from each of the third side surfaces 208. The grease nozzles 222 are arranged in a line parallel to the central axis 201 generally at the corresponding third side surface 208. The grease nozzles 222 communicate with the grease chamber 230.

The moving barrel 200 also protrudes a threaded shaft 226 from the top surface 210 along the central axis 201 and outside first main body 102 via the shaft hole 110.

Each of the grinding plates 300 includes an arc abrading surface 302. Referring back to FIG. 2, after the grinding plates 300 are installed to the installation grooves 214, the arc surface 302 faces outside but is spaced from the workpieces when the moving barrel 200 is positioned at the center of the hexagonal prism chamber 104.

Referring back to FIG. 1, the actuator 400 includes a rotating motor 402, three linear motors 404, and a cylinder 418. The rotating motor 402 includes a rotor 412*r* and a stator 412*r*. The rotor 412*r* is fixed to the threaded shaft 226. Three linear motors 404 are stacked on the stator 412*s*. The linear motor 404 which contacts the stator 412*s* includes a first moving part 406 and a first stator 408. The first moving part 406 is fixed to the stator 412*s*. The linear motor 404 which is disposed on the first stator 408 includes a second moving part 410 and a second stator 412. The second moving part 410 is fixed to the first stator 408. The included angle between the first stator 408 and the second stator 412 is about 60 degrees. The linear motor 404 which is disposed on the second stator 412 includes a third moving part 414 and a third stator 146. The third moving part 414 is fixed to the second stator 412. The included angle between the second stator 412 and the third stator 416 is about 60 degrees. The cylinder 418 includes a chamber 418*c* and a piston part 418*p*. The piston part 418*p* is fixed to the third stator 416. The chamber 418*c* is fixed in place.

In operation, the moving barrel 200 is driven by the three linear motors 404 to move until one of the arc surfaces 302 of the grinding plates 300 (hereinafter "the working grinding plate 300") contacts the one of the workpieces (hereinafter "the currently grinded workpiece"). Then, the moving barrel 200 is driven by the rotating motor 402 and the cylinder 418 to spin and move back and forth along the central axis 201. As such, the currently grinded workpiece is grinded by the working grinding plate 300. During the grinding of the currently grinded workpiece, the three linear motors 404 continuously drive the moving barrel 200 to move towards the currently grinded workpiece in a fine fashion until a desired arc surface is formed on the currently grinded workpiece. Then, the three linear motors 404 drive the moving barrel 200 moving towards another workpiece.

The grinding device 10 holds more than one workpiece using three dimension space. Area of the ground is saved and therefore is advantageous.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A grinding device, comprising:

a fixed barrel defining a chamber therein and comprising a plurality of inner surfaces, the inner surfaces being substantially parallel to a central axis of the fixed barrel, each of the inner surfaces defining a holding groove therein for holding a workpiece;

a moving barrel received in the chamber and comprising a first side surface, the side surface being substantially parallel to the central axis and defining an installation groove;

a grinding plate installed in the installation groove; and an actuator configured for driving the moving barrel to spin and move back and forth along the central axis, and driving the moving barrel to move towards a workpiece so that a surface of the workpiece is grinded into a desired arc surface by the grinding plate, and driving the moving barrel to move towards another workpiece after the desired arc surface of the workpiece is obtained.

2. The grinding device of claim 1, wherein the fixed barrel defines a plurality of suction holes, each of the suction hole communicating a corresponding holding groove with a vacuum source.

3. The grinding device of claim 1, wherein the moving barrel defines a suction hole, the suction hole communicating with the installation hole to a vacuum source.

4. The grinding device of claim 1, wherein the moving barrel comprises a second side surface substantially parallel to the central axis, the moving barrel defining a water chamber therein for storing water, and protruding a water nozzle outwards from the second side surface, the water nozzle communicating the water chamber.

5. The grinding device of claim 1, wherein the moving barrel comprises a third side surface substantially parallel to the central axis, the moving barrel defining a grease chamber therein for storing grinding grease, and protruding a grease nozzle outwards from the third side surface, the grease nozzle communicating the grease chamber.

6. The grinding device of claim 1, wherein the moving barrel comprising a main body and an inner tube, the main body comprising the first side surface, a second side surface, and a third side surface, the second side surface and the third side surface being parallel to the central axis, the inner tube being received in the main body, the main body and the inner tube cooperatively defining a water chamber therebetween, the inner tube defining a grease chamber therein, the main body protruding a water nozzle away from the second side surface and protruding a grease nozzle away from the third side surface, the water nozzle communicating the water chamber, the grease nozzle communicating the grease chamber.

7. The grinding device of claim 1, wherein the grinding plate comprises an arc abrading surface for abrading a surface of the workpiece into a desired arc surface.

8. The grinding device of claim 1, wherein the actuator comprises a rotating motor, a linear motor system, and a cylinder, the rotating motor being configured for rotating the moving barrel, the linear motor system being configured for driving the moving barrel to move towards to a desired workpiece, the cylinder being configured for driving the moving barrel to move along the central axis.

* * * * *